US009959959B2

(12) United States Patent
Jensen et al.

(10) Patent No.: US 9,959,959 B2
(45) Date of Patent: May 1, 2018

(54) MAGNETIC STEEL SHEET HAVING A LAYER IMPROVING THE ELECTRICAL INSULATION AND METHOD FOR THE PRODUCTION THEREOF

(71) Applicant: SIEMENS AKTIENGESELLSCHAFT, Munich (DE)

(72) Inventors: Jens Dahl Jensen, Berlin (DE); Axel Möhle, Berlin (DE); Ralph Reiche, Berlin (DE); Manuela Schneider, Berlin (DE); Oliver Stier, Berlin (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days. days.

(21) Appl. No.: 14/890,343

(22) PCT Filed: Apr. 17, 2014

(86) PCT No.: PCT/EP2014/057879
§ 371 (c)(1),
(2) Date: Nov. 10, 2015

(87) PCT Pub. No.: WO2014/180646
PCT Pub. Date: Nov. 13, 2014

(65) Prior Publication Data

US 2016/0125986 A1 May 5, 2016

(30) Foreign Application Priority Data

May 10, 2013 (DE) ..... 10 2013 208 617

(51) Int. Cl.
*H01F 1/18* (2006.01)
*C21D 8/12* (2006.01)
(Continued)

(52) U.S. Cl.
CPC ..... *H01F 1/18* (2013.01); *C21D 1/74* (2013.01); *C21D 8/1277* (2013.01);
(Continued)

(58) Field of Classification Search
None
See application file for complete search history.

(56) References Cited

U.S. PATENT DOCUMENTS 2,691,460 A 10/1954 Barnebey
3,950,575 A * 4/1976 Kitayama ..... C21D 1/70 427/226

(Continued)

FOREIGN PATENT DOCUMENTS

DE 1115555 10/1961
DE 2 353 796 5/1974

(Continued)

OTHER PUBLICATIONS

Australian Office Action, Application No. 2014264849, 3 pages, dated Mar. 22, 2016.

(Continued)

*Primary Examiner* — Kevin M Bernatz
(74) *Attorney, Agent, or Firm* — Slayden Grubert Beard PLLC

(57) ABSTRACT

A magnetic steel sheet including a layer adjoining at least one of a top side and bottom side of the magnetic metal sheet. The layer includes a metal oxide containing titanium oxide or tantalum oxide and the layer adjoins the magnetic steel sheet along a diffusion zone into which the titanium or tantalum of the metal oxide has diffused into the magnetic steel sheet. The diffusion zone is produced on at least one of a top surface and a bottom surface of the magnetic steel sheet and the diffusion layer diffuses one of tantalum and titanium as metal into the at least one surface. The metal of (Continued)

the at the at least one surface is converted into an associated metal oxide to form the layer including the metal oxide, and a residual content of the metal of the metal oxide remains in the diffusion zone.

2 Claims, 2 Drawing Sheets

(51) Int. Cl.

| | |
|---|---|
| ***C23C 8/02*** | (2006.01) |
| ***C23C 8/10*** | (2006.01) |
| ***C23C 10/28*** | (2006.01) |
| ***C23C 10/60*** | (2006.01) |
| ***C21D 1/74*** | (2006.01) |
| ***C21D 9/46*** | (2006.01) |

(52) U.S. Cl.
CPC ..... *C21D 8/1283* (2013.01); *C21D 9/46* (2013.01); *C23C 8/02* (2013.01); *C23C 8/10* (2013.01); *C23C 10/28* (2013.01); *C23C 10/60* (2013.01)

(56) References Cited

U.S. PATENT DOCUMENTS

| | | | | |
|---|---|---|---|---|
| 4,762,753 | A | 8/1988 | Perfetti | |
| 4,863,531 | A | 9/1989 | Wada et al. | |
| 5,411,808 | A | 5/1995 | Kanai et al. | |
| 6,129,994 | A * | 10/2000 | Harada | C23C 4/02 427/376.2 |
| 7,077,895 | B2 | 7/2006 | Akui et al. | 106/287.19 |
| 7,169,479 | B2 | 1/2007 | Schuhmacher et al. | |
| 2004/0244648 | A1 * | 12/2004 | Akui | C01G 23/04 106/287.19 |
| 2007/0262668 | A1 * | 11/2007 | Brisson | F16C 32/0468 310/90.5 |
| 2016/0086754 | A1 * | 3/2016 | Shimoda | H01H 50/28 335/2 |

FOREIGN PATENT DOCUMENTS

| | | | |
|---|---|---|---|
| DE | 35 36 737 | A1 | 4/1986 |
| DE | 693 29 718 | T2 | 4/2001 |
| DE | 101 30 308 | A1 | 1/2003 |
| DE | 10 2008 039 326 | A1 | 2/2010 |
| EP | 0 077 535 | A1 | 4/1983 |
| EP | 0 910 101 | A1 | 4/1999 |
| GB | 852265 | | 10/1960 |
| GB | 913369 | | 12/1962 |
| GB | 1 448 718 | | 9/1976 |
| JP | 62-23984 | | 1/1987 |
| JP | 6-215622 | | 8/1994 |
| JP | 2007-154269 | | 6/2007 |
| WO | 2008/154122 | A1 | 12/2008 |

OTHER PUBLICATIONS

English Abstract of Japanese Patent Application Publication No. 53-50019 dated Apr. 8, 1978 (Derwent Accession No. 1978-43006A).

English Abstract of Japanese Patent Application Publication No. 59-47371 dated Mar. 17, 1984 (Derwent Accession No. 1984-104398).

Nemethova et al., "Influence of Slab Temperature to Adhesion of Furnace Scales"; Acta Metallurgica Slovacia, vol. 15; 2009; pp. 23-30.

Search Report dated Sep. 26, 2013 in corresponding German Patent Application No. 10 2013 208 617.2; 5 pp.

International Search Report for International Patent Application No. PCT/EP2014/057879 dated Jul. 16, 2014; 3 pp.

PCT/EP2014/057879, filing date Apr. 17, 2014, Jens Dahl Jensen et al.

102013208617.2, filing date May 10, 2013, Jens Dahl Jensen et al.

Australian Notice of Allowance, Application No. 2014264849, 3 pages, dated Oct. 4, 2016.

* cited by examiner

MAGNETIC STEEL SHEET HAVING A LAYER IMPROVING THE ELECTRICAL INSULATION AND METHOD FOR THE PRODUCTION THEREOF

CROSS REFERENCE TO RELATED APPLICATIONS

This application is based on and hereby claims priority to International Application No. PCT/EP2014/057879 filed on Apr. 17, 2014 and German Application No. 10 2013 208 617.2 filed on May 10, 2013; the contents of both are hereby incorporated by reference.

BACKGROUND

According to the known art, magnetic steel sheets having a layer that improves the electrical insulation are used, for example, in electric drives for the design of stators. The materials used are regulated by the standard EN 10106 (1995). The materials named in this standard give a wide-ranging product range in order that the demands of different applications can be satisfied. The usable materials range from low-alloyed steel, with outstanding magnetic permeability, good thermal conductivity and good stamping properties, to higher-alloyed steels having very low remagnetization losses even at higher frequencies. As alloying constituents, the alloys in the standard contain copper (<=0.02%), manganese (<=1.2%), silicon (0.1-4.4%), aluminum (0.1-4.4%), the sum formed from the silicon content and twice the aluminum content being <5%, phosphorus (<=0.15%), tin (<=0.2%) and antimony (<=0.2%). Iron forms the basis of the alloy.

Coatings which improve the insulation between the individual steel sheet layers and the processability have been developed for improving the properties of the magnetic steel sheets. The specific properties of the material used have to take into consideration influencing variables, such as corrosion protection, electrical insulation, influence on the stamping properties, heat resistance or weldability. Coatings for magnetic steel sheets can be gathered from the standard EN 10342 (2005).

The magnetic steel sheets available in the aforementioned standards, and the coatings thereof, cannot withstand all fields of use, however, as has been shown. Particularly when the magnetic steel sheets are exposed to highly corrosive media, e.g. sour gas (high hydrogen sulfide content), these magnetic steel sheets are at great risk of corrosion.

SUMMARY

Various embodiments described herein relate to a magnetic steel sheet having a layer which improves the electrical insulation.

Various embodiments described herein relate to a magnetic steel sheet which is also suitable for use under highly corrosive conditions.

The layer includes a metal oxide containing mainly titanium oxide or tantalum oxide, and the magnetic steel sheet has a diffusion zone, into which the metal of the metal oxide has diffused into the material of the magnetic steel sheet and which adjoins the layer. Since the oxide layer adjoins a diffusion layer, the adhesion of the oxide layer is greatly improved. The use of the metals titanium or tantalum has the effect that the oxide layer which forms spontaneously on the surface of the magnetic steel sheet is highly resistant to corrosive media. Use under extreme corrosive conditions, e.g. sour gas, thereby also becomes possible. By way of example, it is possible to operate motor pumps which are used for conveying natural gas in a subsea environment. This gives rise to a new application for the magnetic steel sheets, these permitting the use of the electric machines under favorable conditions for maintenance.

If the oxide layers which form spontaneously under atmospheric oxygen are not adequate to provide effective corrosion protection, the oxide layer can also be produced by an electrochemical treatment of the surface.

The diffusion zone, which adjoins the oxide layer, has two advantages. Firstly, the diffusion zone improves the adhesion of the oxide layer, since the transition between the oxide layer and the matrix material of the magnetic steel sheet, a steel alloy, is continuous, and this reduces the formation of stresses. In addition, it is possible that, in the event of damage to the oxide layer, the titanium or tantalum material present in the diffusion layer can be used for passivation of the damaged site. To this end, the metal in question diffuses to the surface, where renewed passivation takes place. The corrosion protection is thereby retained.

According to various embodiments described herein, the layer has a thickness of at least 5 and at most 10 μm. These are layer thicknesses of the oxide layer which allow for effective corrosion protection and require little manufacturing outlay and little use of material in their production owing to the small thickness.

According to various embodiments described herein, the diffusion zone has a titanium or tantalum content of more than 50% by weight within a distance of 2 μm from the interface with the layer. These are alloying contents which still allow for the diffusion-induced transportation of titanium or tantalum to damaged sites. In this case, it is also possible for titanium or tantalum contents of up to 100% to arise directly beneath the oxide layer. The titanium or tantalum content in the matrix of the magnetic steel sheet (alloyed steel) reduces with an increasing distance from the surface of the magnetic steel sheet, and therefore the effect which improves the adhesion of the oxide layer can be utilized.

Various embodiments described herein relate to a method for treating a magnetic steel sheet, in which the magnetic steel sheet is coated with a layer which improves the electrical insulation. Various embodiments described herein relate to a method which makes it possible to treat magnetic steel sheets and which produces products which ensure adequate corrosion protection even under highly corrosive influences.

A diffusion zone is produced on the surface of the magnetic steel sheet, tantalum or titanium diffusing as metal into the surface. The tantalum or titanium metal at the surface is converted into the associated metal oxide, titanium oxide or tantalum oxide, a layer including the metal oxide being formed and a residual content of the metal of the metal oxide remaining in the diffusion zone. This produces the oxide layer described above, which has outstanding resistance to corrosion. The residual content of the metal of the metal oxide remains in the diffusion zone, as a result of which, the adhesion of the oxide layer is improved. In addition, the diffusion zone forms a deposit of the corresponding material, and in the event of damage to the oxide layer this is available for healing the damage by spontaneous passivation.

Before the formation of the layer, the diffusion zone has a titanium or tantalum content of more than 50% by weight within a distance of 5 μm from the interface with the layer. Before the formation of the layer, the diffusion zone has to have a larger region with a high titanium or tantalum concentration, since oxidation of the titanium or tantalum converts part of the previously formed diffusion layer into the oxide layer. In order for there to still be sufficient material available for repairing the oxide layer in the matrix of the magnetic steel sheet after this oxidation operation, the proportion of titanium or tantalum therefore has to be sufficiently high.

Various methods described herein can be carried out in such a way that the production of the diffusion zone on the surface of the magnetic steel sheet is carried out as a physical (PVD) process with a subsequent heat treatment. PVD processes are easy to handle. Both titanium and tantalum can be deposited on steel by using suitable target materials. Titanium is deposited in many ways by PVD processes, for example to produce tool coatings, this normally being effected in a reactive nitrogen atmosphere, in order to be able to produce titanium nitride. If an inert gas atmosphere is chosen instead, pure titanium is deposited. It is also possible for tantalum to be deposited readily on steel. A process of this type is described, for example, in EP 77 535 A1. Titanium can also be deposited, for example, by spraying or powder coating, as can be gathered, for example, from the Derwent Abstract with the Accession Number 1978-43006 A. The powder processes are also referred to as packing processes, where the diffusion layers arise as a result of the diffusion of the tantalum into the workpiece. Unlike in PVD processes, the diffusion layer thus forms immediately, whereas in PVD processes a heat treatment has to take place after the coating operation, this leading to diffusion of the tantalum or of the titanium into the matrix of the magnetic steel sheet. Parameters for diffusion treatments of this nature are generally known and can be gathered, for example, from the Derwent Abstract with the Accession Number 1984-104398. In addition to the aforementioned treatment methods, electrochemical coatings, for example in a salt bath, or else coating by means of chemical (CVD) are also conceivable in principle.

If a passivation layer which forms spontaneously on the titanium or the tantalum is not adequate for effective corrosion protection, but rather the passivation layer is to be produced electrochemically, a passivation layer which forms spontaneously beforehand may be removed. In this way, the electrochemically assisted formation of the passivation layer can be effected uninterrupted. The heat treatment then takes place in an oxygen-containing atmosphere, it also being possible for the oxygen to be enriched compared to atmospheric conditions in order to accelerate the oxidation operation.

BRIEF DESCRIPTION OF THE DRAWINGS

These and other objects and advantages will become more apparent and more readily appreciated from the following description of the various embodiments, taken in conjunction with the accompanying drawings of which.

DETAILED DESCRIPTION OF THE PREFERRED EMBODIMENT

Figure 1:
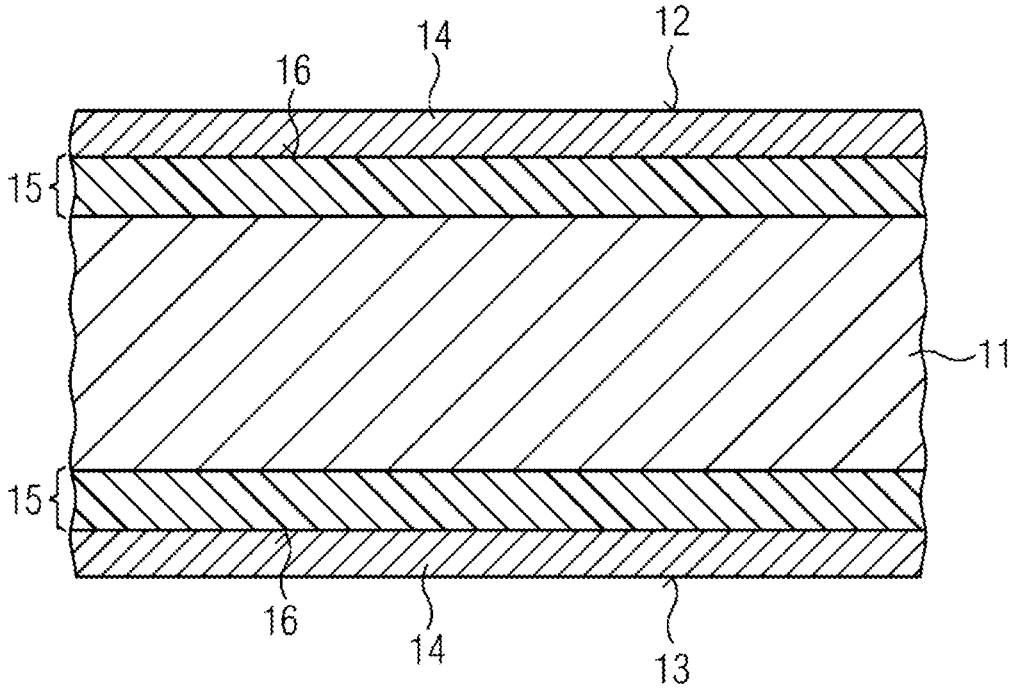
FIG. 1 is a cross-section of a magnetic steel sheet.

Reference will now be made in detail to the various embodiments, examples of which are illustrated in the accompanying drawings, wherein like reference numerals refer to like elements throughout.

FIG. 1 illustrates a magnetic steel sheet 11, the top side 12 and bottom side 13 of which are each provided with a layer 14 of tantalum oxide. This layer 14 adjoins a diffusion zone 15, which has a common interface 16 with the layer 14 of tantalum oxide. Behind the interface, the concentration of tantalum in the diffusion zone is far greater than 50%. This continues to fall toward the interior of the magnetic steel sheet 11, until the concentration is 0% by weight. A boundary between the actual magnetic steel sheet 11 and the diffusion zone 15 therefore cannot actually be shown per se. The figure does show, however, that region in which the concentration of tantalum in the microstructure of the magnetic steel sheet 11 is above 50%.

Figure 2:
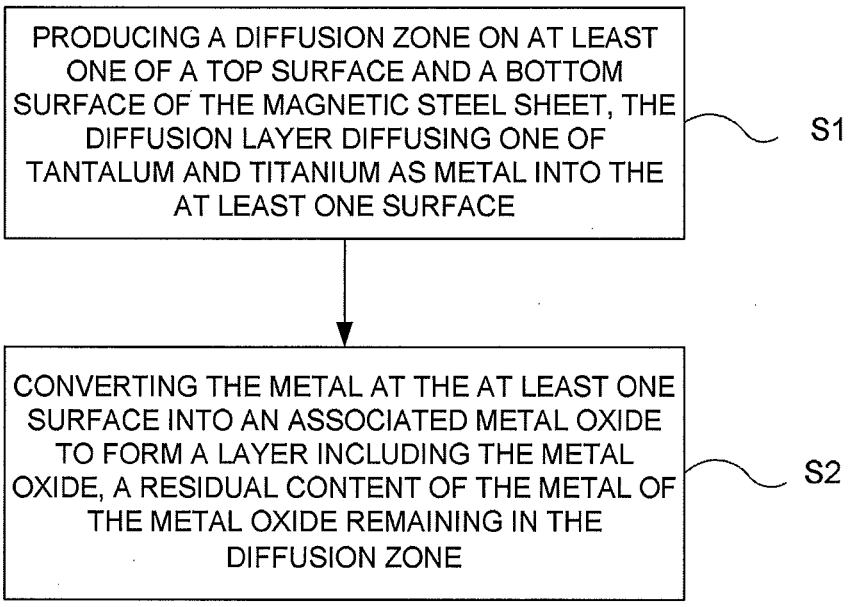
FIG. 2 is a flowchart of an exemplary embodiment of a method for producing the magnetic steel sheet.

FIG. 2 illustrates an embodiment of a method. In S1, a diffusion zone is produced on at least one of a top surface and a bottom surface of the magnetic steel sheet. The diffusion layer diffuses one of tantalum and titanium as metal into the at least one surface. In S2, the metal of the at the at least one surface is converted into an associated metal oxide to form the layer including the metal oxide, and a residual content of the metal of the metal oxide remains in the diffusion zone.

The various embodiments have been described in detail with particular reference and examples, but it will be understood that variations and modifications can be effected within the spirit and scope of the various embodiments covered by the claims which may include the phrase "at least one of A, B and C" as an alternative expression that means one or more of A, B and C may be used, contrary to the holding in *Superguide* v. *DIRECTV,* 69 USPQ2d 1865 (Fed. Cir. 2004).

The invention claimed is:

1. A steel sheet, comprising:

a magnetic steel sheet core;

a diffusion zone formed at a side of the magnetic steel sheet core, the diffusion zone including a metal diffused into the diffusion zone in a direction toward an internal area of the magnetic steel sheet core, the metal comprising titanium or tantalum;

wherein the diffusion zone includes more than fifty percent by weight of the metal up to 2 μm from an exterior side of the diffusion zone facing away from the internal area; and a metal oxide layer formed at the exterior side the diffusion zone, such that the diffusion zone is located between the metal oxide layer and the internal area of the magnetic steel sheet core, wherein the metal oxide layer comprises an associated metal oxide of the metal in the diffusion zone, the diffusion zone comprises a remaining residual content of the metal, and the concentration of the metal in the diffusion zone decreases from 100% by weight at an interface with the metal oxide layer to 0% by weight in the direction extending toward the internal area of the magnetic steel sheet core.

2. The magnetic steel sheet as claimed in claim 1, wherein the metal oxide layer has a thickness of between 5 μm and 10 μm inclusive.

* * * * *